US005800130A

United States Patent [19]

Blass et al.

[11] Patent Number: 5,800,130

[45] Date of Patent: Sep. 1, 1998

[54] PRESSURE CONTROL SYSTEM FOR A VARIABLE DISPLACEMENT HYDRAULIC PUMP

[75] Inventors: James R. Blass, Bloomington; Gregory G. Hafner, Normal, both of Ill.

[73] Assignee: Caterpillar Inc., Peoria, Ill.

[21] Appl. No.: 769,872

[22] Filed: Dec. 19, 1996

[51] Int. Cl.[6] ..... F04B 1/26; F16D 31/02

[52] U.S. Cl. ..... 417/213; 60/452

[58] Field of Search ..... 60/452; 417/213, 417/222.1, 270

[56] References Cited

U.S. PATENT DOCUMENTS

| | | | |
|---|---|---|---|
| 3,820,920 | 6/1974 | Klimaszewski et al. | 417/213 |
| 4,478,136 | 10/1984 | Heiser et al. | 91/506 |
| 4,699,571 | 10/1987 | Bartholomaus | 417/213 |
| 5,515,829 | 5/1996 | Wear et al. | 123/446 |

FOREIGN PATENT DOCUMENTS

| | | | |
|---|---|---|---|
| 58-222988 | 12/1983 | Japan | 417/213 |
| 58-222990 | 12/1983 | Japan | 417/213 |

*Primary Examiner*—Charles G. Freay

*Attorney, Agent, or Firm*—John W. Grant

[57] ABSTRACT

A displacement control valve includes a valve element having a first operative position communicating a displacement controller of a variable displacement hydraulic pump with a tank for increasing the pump displacement and a second operative position communicating a discharge passage of the pump with the control port for decreasing pump displacement. The discharge passage communicates with a first end of the valve element to generate a force biasing the valve element toward the second position. An opposing biasing force is exerted on the valve element in opposition to the pressure generated force acting on the first end of the valve element so that a predetermined pressure level is established in the discharge passage when the forces acting on the valve element are equalized. The opposing biasing force is generated by a spring disposed to exert a substantially constant biasing force on the valve element and an orifice device for generating a fluid pressure at the second end of the valve element commensurate with the pressure in the discharge passage. A variable mechanical biasing force can be exerted on the valve element in concert with the opposing biasing force to change the pressure level in the discharge passage proportional to the level of the mechanical biasing force.

7 Claims, 1 Drawing Sheet

PRESSURE CONTROL SYSTEM FOR A VARIABLE DISPLACEMENT HYDRAULIC PUMP

TECHNICAL FIELD

This invention relates generally to a variable displacement hydraulic pump and, more particularly, to a pressure control system for controlling the discharge pressure of the pump.

BACKGROUND ART

Many variable displacement hydraulic pumps are used in systems in which displacement of the pump is normally defaulted to a setting to maintain a predetermined pressure level but which can be changed to deviate from the predetermined pressure level in response to system demands. One such variable displacement pump and the control system therefor is disclosed in U.S. Pat. No. 5,515,829 wherein the variable displacement pump supplies pressurized oil to a hydraulically actuated fuel injection system for a diesel engine. The control system is electronically controlled to provide the pressurized oil needed to actuate the fuel injectors. Electronic control of the system pressure is accomplished by the use of a standalone proportional valve and a modified load-sensing compensator. That design has a constant flow through and constant differential pressure across the valve spool for all steady state discharge pressure conditions. One of the problems associated with that control is that several complex components are used which increases cost and could have a negative impact on product reliability.

The present invention is directed to overcoming one or more of the problems as set forth above.

DISCLOSURE OF THE INVENTION

In one aspect of the present invention, a pressure control system adapted for use with a variable displacement hydraulic pump having a discharge passage and a displacement controller disposed to decrease pump displacement in response to an increasing pressure signal and to increase pump displacement in response to a decreasing pressure signal. The pressure control system includes a displacement control valve having an inlet port communicating with the discharge passage, a control port communicating with the displacement controller, an exhaust port, and a valve element having a first operative position communicating the control port with the exhaust port and a second operative position communicating the inlet port with the control port. The first end of the valve element continuously communicates with the inlet port to generate a force biasing the valve element toward the second position. A first device exerts a biasing force on the valve element in opposition to the pressure generated force acting on the first end of the valve element so that a pressure level is established in the discharge passage when the forces acting on the valve element are in equilibrium. The first device includes a spring disposed to exert a substantially constant biasing force on the valve element and an orifice device to generate a fluid pressure at the second end of the valve element commensurate with the pressure in the discharge passage. A mechanical biasing force can be selectively exerted on the valve element in concert with the first device to change the pressure level in the discharge passage proportional to the level of the mechanical biasing force.

BEST MODE FOR CARRYING OUT THE INVENTION

Figure 1:
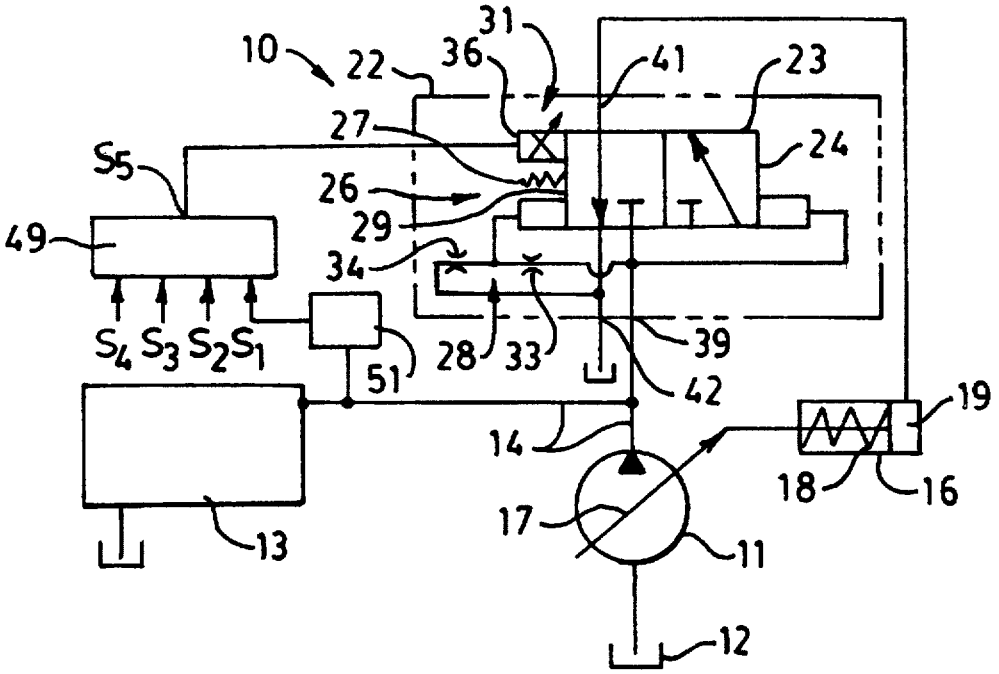
FIG. 1 is a schematic illustration of an embodiment of the present invention.

Referring now to the drawings, a pump pressure control system 10 is shown in combination with a variable displacement axial piston hydraulic pump 11 connected to a tank 12 and to a workstation 13 through a discharge passage 14. The hydraulic pump 11 includes a displacement controller 16 connected to a displacement control element 17. In this embodiment, the displacement controller 16 includes a spring 18 resiliently biasing the displacement control element 17 to its maximum displacement setting so that increasing control pressure directed to a fluid chamber 19 of the displacement controller decreases the pump displacement and decreasing the control pressure increases the pump displacement. For an understanding of the present invention, it will be understood that increasing the fluid pressure in the discharge passage is achieved by increasing the pump displacement while decreasing the fluid pressure in the discharge passage is achieved by decreasing the pump displacement.

The pump pressure control system 10 includes a displacement control valve 22 having a valve element 23 movable to a first operative position communicating the fluid chamber 19 of the displacement controller 16 with the tank 12 and another operative position communicating the discharge passage 14 with the fluid chamber 19. The discharge passage 14 continuously communicates with an end 24 of the valve element 23 to generate a force biasing the valve element toward the second position. The displacement control valve also includes a means 26 for exerting a biasing force in opposition to the force generated by the discharge pressure in the discharge passage 14. The means 26 can include, for example, a spring 27 disposed to exert a substantially constant biasing force on the valve element 23 and an orifice means 28 for generating a fluid pressure at another end 29 of the valve element 23 commensurate with the pressure in the discharge passage. The control valve further includes a means 31 for exerting a mechanical biasing force on the valve element 23 in concert with the means 26 to increase the pressure level in the discharge passage proportional to the level of the mechanical biasing force. The orifice means 28 can include, for example, a fixed size orifice 33 disposed between the discharge passage 14 and the end 29 of the valve element and another orifice 34 disposed between the end 29 and the tank 12. The mechanical biasing means 32 can include, for example, a proportional solenoid 36 disposed at the end 29 of the valve element 23.

Figure 2:
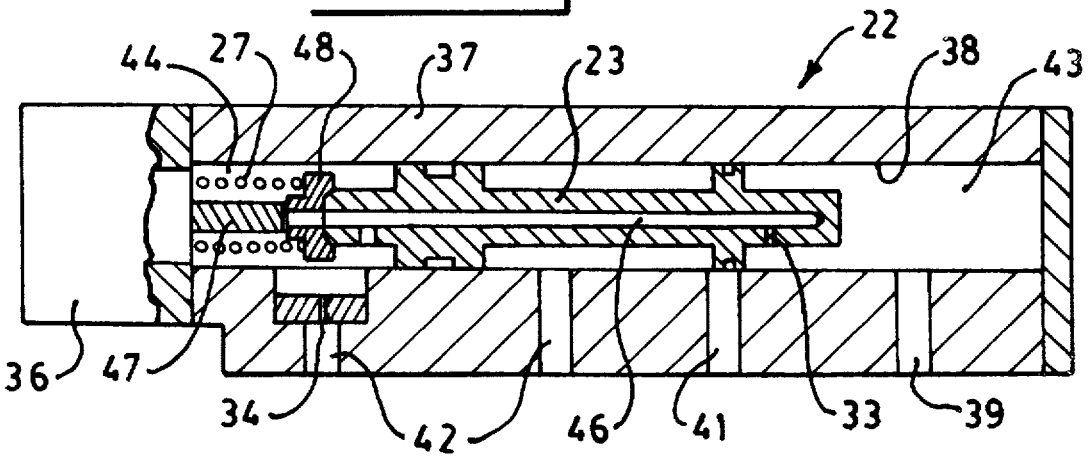
FIG. 2 is a diagrammatic illustration of a displacement control valve schematically illustrated in FIG. 1.

Referring more specifically to FIG. 2, the displacement control valve 22 includes a valve body 37 defining-a cylindrical bore 38, an input port 39 communicating the discharge passage 14 with the cylindrical bore, a control port 41 communicating the cylindrical bore 38 with the fluid chamber 19, and an exhaust port 42 communicating the bore with the tank 12. The valve element 23 is slidably disposed in the cylindrical bore defining a pair of fluid chambers 43,44 at opposite ends of the valve element. The chamber 43 continuously communicates with the discharge passage 14 through the input port 39. A passageway 46 defined in the valve element communicates the chamber 43 with the chamber 44 through the orifice 33. The orifice 34 communicates the chamber 44 with the exhaust passage 42 connected to the tank. The proportional solenoid 36 is suitably connected to the valve body 37 and has a push rod 47 disposed to mechanically engage the end 29 of the valve element through a spring retainer 48. The spring 27 is disposed between the proportional solenoid and the spring retainer.

The work system 13 in this embodiment can be, for example, a hydraulically actuated fuel injection system as disclosed in U.S. Pat. No. 5,515,829 and includes an electronic control module 49 disposed to receive input data signals S1–S4, process the input data signals and transmit a control signal S5 to the proportional solenoid 36. The input data signals are transmitted from one or more signal indicating devices, one being shown at 51 which is a pressure transducer connected to the discharge passage 29. The pressure transducer 51 is able to detect the pressure of the hydraulic actuating fluid in the discharge passage 14 and to generate a pressure signal indicative of the pressure detected. The input data signals may include for example engine speed, engine crankshaft position, engine coolant temperature, engine exhaust back pressure, air intake manifold pressure, throttle position or desired fuel setting, or gear setting of the transmission.

INDUSTRIAL APPLICABILITY

The displacement controller 16 is responsive to the level of control pressure in the control port 41 and increases the displacement of the variable displacement pump 11 when the control pressure decreases and decreases the displacement of the pump when the control pressure increases. The valve element 23 of the displacement control valve 22 is shown at a default position that it would occupy when the proportional solenoid 36 is de-energized and the pump 11 is not being driven.

The control port 41 communicates with the exhaust port 42 at the default position of the valve element resulting in the variable displacement pump 11 being at its maximum displacement position. Thus, fluid flow is transmitted through the discharge passage 14 to the workstation 13 and into the control chamber 43 of the displacement control valve immediately upon startup of the power source that drives the variable displacement pump. As the pressure in the discharge passage 14 increases, the valve element 23 moves leftward initially against the bias of the spring 27. However, some of the fluid entering the chamber 43 passes through the orifice 33 and the passageway 46 into the chamber 44 and out of the chamber 44 to the exhaust port 42 through the orifice 34. This establishes a differential pressure between the chambers 43 and 44 so that a pressure generated force also acts against the end 24 of the valve element in concert with the spring 27. The leftward movement of the valve spool sequentially blocks communication between the control port 41 and the exhaust port 42 and establishes communication between the input port 39 and the control port 41 to direct control pressure to the chamber 19 of the displacement controller 16. The increasing control pressure directed to the fluid chamber 19 causes the displacement controller to start reducing the pump displacement. When the discharge pressure in the discharge passage 14 reaches a predetermined level, the opposing forces acting on the valve spool equalize and movement of the valve element 23 stops so that the displacement of the pump is held to maintain the discharge pressure at the predetermined level.

Any fluctuation in the discharge pressure will cause the valve element to shift to change the displacement of the variable displacement pump to reestablish the predetermined pressure level. For example, if the discharge pressure decreases, the valve element will shift rightward to decrease the control pressure directed to the displacement controller 16 to increase the displacement of the pump until the predetermined level of discharge pressure is regained. Conversely, an increase in the discharge pressure causes the displacement of the pump to decrease to maintain the predetermined pressure level.

The displacement of the variable displacement pump 11 can be selectively increased by directing an electrical signal to energize the proportional solenoid 36. This causes the push rod 47 to exert an additional force against the valve element 23 in concert with the bias force of the spring 27 and the pressure generated force acting on the end 29 of the valve element so that a greater discharge pressure is required to equalize the forces acting on the valve spool. This results in decreasing the control pressure directed to the displacement controller 16 causing the pump displacement to increase to a new setting commensurate with the strength of the electrical signal directed to the proportional solenoid. Conversely, once the displacement of the variable displacement pump has been increased by directing an electrical signal to the proportional solenoid 36, the displacement of the variable displacement pump can be decreased for decreasing the discharge pressure by reducing the strength of the electrical signal to reduce the force exerted on the valve spool by the push rod.

The relative sizes of the orifices 33 and 34 are selected to adjust the differential pressure across the valve element 23 throughout the operating range of the discharge pressure.

In view of the above, it is readily apparent that the structure of the present invention provides an improved pressure control system for a variable displacement hydraulic pump which includes a low cost displacement control valve having a reduced number of components.

Other aspects, objects and advantages of this invention can be obtained from a study of the drawings, the disclosure and the appended claims.

We claim:

1. A pressure control system adapted for use with a variable displacement hydraulic pump having a discharge passage and a displacement controller disposed to decrease pump displacement in response to an increasing pressure signal and to increase pump displacement in response to a decreasing pressure signal comprising:

a displacement control valve having an inlet port communicating with the discharge passage, a control port communicating with the displacement controller, an exhaust port, a valve element having first and second ends and a first operative position communicating the control port with the exhaust port and a second operative position communicating the inlet port with the control port, the first end being in continuous communication with the inlet port to generate a force biasing the valve element toward the second position, and first means for exerting a biasing force on the valve element in opposition to the pressure generated force acting on the first end of the valve element so that a pressure level is established in the discharge passage when the forces acting on the valve element are in equilibrium, the first means including a spring disposed to exert a substantially constant biasing force on the valve element and an orifice means for generating a fluid pressure at the second end of the valve element commensurate with the pressure in the discharge passage; and a second means for exerting a variable mechanical biasing force on the valve element in concert with the first means to increase the pressure level in the discharge passage proportional to the level of the mechanical biasing force.

2. The pressure control system of claim 1 wherein the orifice means includes a first fixed size orifice communicating the inlet port with the second end of the valve element and a second fixed size orifice communicating the second end of the valve element with the exhaust port.

3. The pressure control system of claim 2 wherein the first orifice is defined in the valve element.

4. The pressure control system of claim 2 wherein the pressure generated forces acting on the second end of the valve element increases proportional to increases in the pressure in the discharge passage.

5. The pressure control system of claim 2 wherein the second means includes a proportional solenoid having a push rod disposed to exert the mechanical biasing force on the valve element when the solenoid is energized.

6. The pressure control system of claim 2 wherein the displacement control valve includes a valve body having a bore slidably receiving the valve element, and the input port, the control port, and the exhaust port communicate with the bore.

7. The pressure control system of claim 6 wherein the valve element defines a first chamber at the first end of the valve element and a second chamber at the second end of the valve element, the first chamber continuously communicates with the inlet port, the first orifice communicates the first chamber with the second chamber and the second orifice communicates the second chamber with the exhaust port.

* * * * *